US007726379B2

(12) United States Patent
Beau

(10) Patent No.: US 7,726,379 B2
(45) Date of Patent: Jun. 1, 2010

(54) DEVICE FOR DRIVING A CLOSING OR SUN-PROTECTION SCREEN AND INSTALLATION COMPRISING SUCH A DEVICE

(75) Inventor: Stephane Beau, Sallanches (FR)

(73) Assignee: Somfy, Cluses (FR)

( * ) Notice: Subject to any disclaimer, the term of this patent is extended or adjusted under 35 U.S.C. 154(b) by 1202 days.

(21) Appl. No.: 10/990,421

(22) Filed: Nov. 18, 2004

(65) Prior Publication Data

US 2005/0103450 A1 May 19, 2005

(30) Foreign Application Priority Data

Nov. 19, 2003 (FR) ..... 03 13546

(51) Int. Cl.
*A47G 5/02* (2006.01)

(52) U.S. Cl. ..... 160/310; 160/7

(58) Field of Classification Search ..... 160/323.1, 160/238, 263, 266, 121.1, 310, 311, 312, 160/188, 7; 296/37.16; 49/31, 199; 310/68 B, 310/68 E, DIG. 3
See application file for complete search history.

(56) References Cited

U.S. PATENT DOCUMENTS 2,474,358 A * 6/1949 Howlett et al. ..... 451/159
4,417,185 A * 11/1983 Bullat ..... 318/2
4,952,830 A * 8/1990 Shirakawa ..... 310/68 B
5,711,360 A * 1/1998 Viotte ..... 160/310
6,225,715 B1 * 5/2001 Hoda et al. ..... 310/67 R
2002/0045509 A1 * 4/2002 Grauby et al. ..... 475/31
2002/0089209 A1 * 7/2002 Kobayashi et al. ..... 296/97.4

FOREIGN PATENT DOCUMENTS

| | | |
|---|---|---|
| DE | 3220441 | 5/1982 |
| EP | 0426577 | 5/1991 |
| EP | 0965724 | 12/1999 |
| FR | 2654229 | 11/1989 |

* cited by examiner

*Primary Examiner*—David Purol
(74) *Attorney, Agent, or Firm*—Dowell & Dowell P.C.

(57) ABSTRACT

A device including a tube for winding and unwinding a screen which is controlled in rotation by a gear motor and which is supported on a fixed head and wherein a rotational part mounted within the tube is kinematically linked to rotate with the tube with the part including elements that are used to reflect a position of the rotational part and which elements are detected by senors that are connected to an electronic processing unit. A tightly sealed partition secured to the head is further provided to define, on one side, a first compartment for receiving at least the rotational part and, on the other side, a second compartment for receiving at least the electronic processing unit.

12 Claims, 4 Drawing Sheets

DEVICE FOR DRIVING A CLOSING OR SUN-PROTECTION SCREEN AND INSTALLATION COMPRISING SUCH A DEVICE

FIELD OF THE INVENTION

The present invention relates to a device for driving a closing or sun-protection screen, as well as to a closure or sun-protection installation incorporating such a device.

A closure installation is understood to mean structures having openings that are closed or covered by doors, blinds, shutters and equivalent devices.

BACKGROUND OF THE INVENTION

In an installation having an opening, a screen, which may be a supple screen body or a rigid or semi-rigid panel, is displaced opposite the opening in order to selectively obturate the latter. In order to make the movement of the screen automatic, it has been proposed in the past to equip it with means for automatically detecting a position and/or a displacement of the screen and thus to use pre-defined positions to control electrical power supply to a screen drive motor, particularly the top and bottom ends of stroke and possibly intermediate positions in which the electrical supply to the motor is interrupted or modified in order to stop the screen or vary its speed and/or its drive torque.

An example of such an automatic drive device is given in FR-A-2 654 229.

Although the afore-mentioned device is satisfactory as to its function of automatic control of the drive of the screen, it presents a drawback concerning its tightness or sealing of components, particularly the tightness or sealing of the electronic processing unit that it contains with respect to the ambient environment. In effect, this type of device is likely to be installed outside and thus to be subjected to bad weather. This results in considerable risks of water infiltrating inside the tube and therefore reaching the electronic processing unit and the electric motor, particularly via the opening necessary for the kinematic links between a transmission means and a ring that rotatably supports the tube. It is difficult to seal this opening tight due to the mobility of the ring which, in addition, must present axial and radial clearances sufficient in order, on one hand, to match winding tubes of various origins whose dimensions are imprecise due to their mode of manufacture and, on another hand, to compensate for clearances of expansion associated with the functioning of the motor and climatic conditions.

In order to overcome this problem, one or more O-rings may be interposed between the ring and the fixed head and it may be attempted to adjust the ring around the fixed head as best possible. Furthermore, as described in EP-A-0 965 724, a ring of magnets of alternate polarities may be mounted around a circular support. These solutions are not economical as they require more voluminous parts, particular geometries at the level of the elements in contact and/or a complex process of assembly. In the device known from EP-A-0 965 724, the ring of magnets is expensive and the precision of measurement depends on the angular deviation between the peripheral magnets. This deviation being fixed by the diameter of the support which depends on the type of motor used, it cannot be adjusted easily.

In the domain of automatically controlled electric motors, U.S. Pat. No. 4,952,830 proposes embedding in an appropriate resin electronic sensors for detecting the displacement of the rotor of a motor, these sensors being kinematically linked to the stator. The tightness of the sensors is thus ensured but this solution does not guarantee tightness of the conductors connecting the sensors to an electronic unit for processing the signals furnished by these sensors. In other words, the potential problems of tightness do not affect the sensors as such but concern the more remote electronic components of the processing unit.

It is an object of the present invention to propose a device of the afore-mentioned type, in which the parts of the device sensitive to water are efficiently protected, particularly the electronic components of this device.

SUMMARY OF THE INVENTION

To that end, the invention relates to a device for driving a closing or sun-protection screen that includes a gear motor unit mounted within a winding tube for displacing the screen and which is controlled in rotation about an axis by the gear motor unit. A head is fixedly mounted on a bearing structure and supports the winding tube, a rotatable part having elements that are representative of a position and/or a displacement of the tube and which part is kinematically linked to rotate with the tube by mechanical transmission means, and sensor means for detecting the position and/or the displacement of the part. The sensor means is connected to an electronic processing unit adapted to determine the position and/or the displacement of the tube. A partition secured to and extending from the head defines, on one side, a first compartment for receiving at least the rotatable part and, on another side, a second compartment for receiving at least the electronic processing unit. The partition effectively seals the electronic processing unit from the rotatable part and thus the ambient environment.

The tightly sealed partition of the device according to the invention makes it possible hermetically to define respective hollow housings for the mobile part having elements representative of the position and/or the displacement of the tube and for at least the electronic processing unit that is sensitive to humidity and water coming from outside the device. This partition is secured to or integral with the head fixed with respect to the bearing structure. Such a structure does not complicate assembly and installation of the device.

Other characteristics of this device, taken separately or in all technically possible combinations, are set forth in claims 2 to 9.

The invention also relates to a closure or sun-protection installation which comprises a screen adapted to be driven by a device as defined hereinabove.

Such an installation is economical, reliable and long-lasting.

BRIEF DESCRIPTION OF THE DRAWINGS

The invention will be more readily understood on reading the following description given solely by way of example and made with reference to the accompanying drawings, in which.

DESCRIPTION OF PREFERRED EMBODIMENTS

Figure 1:
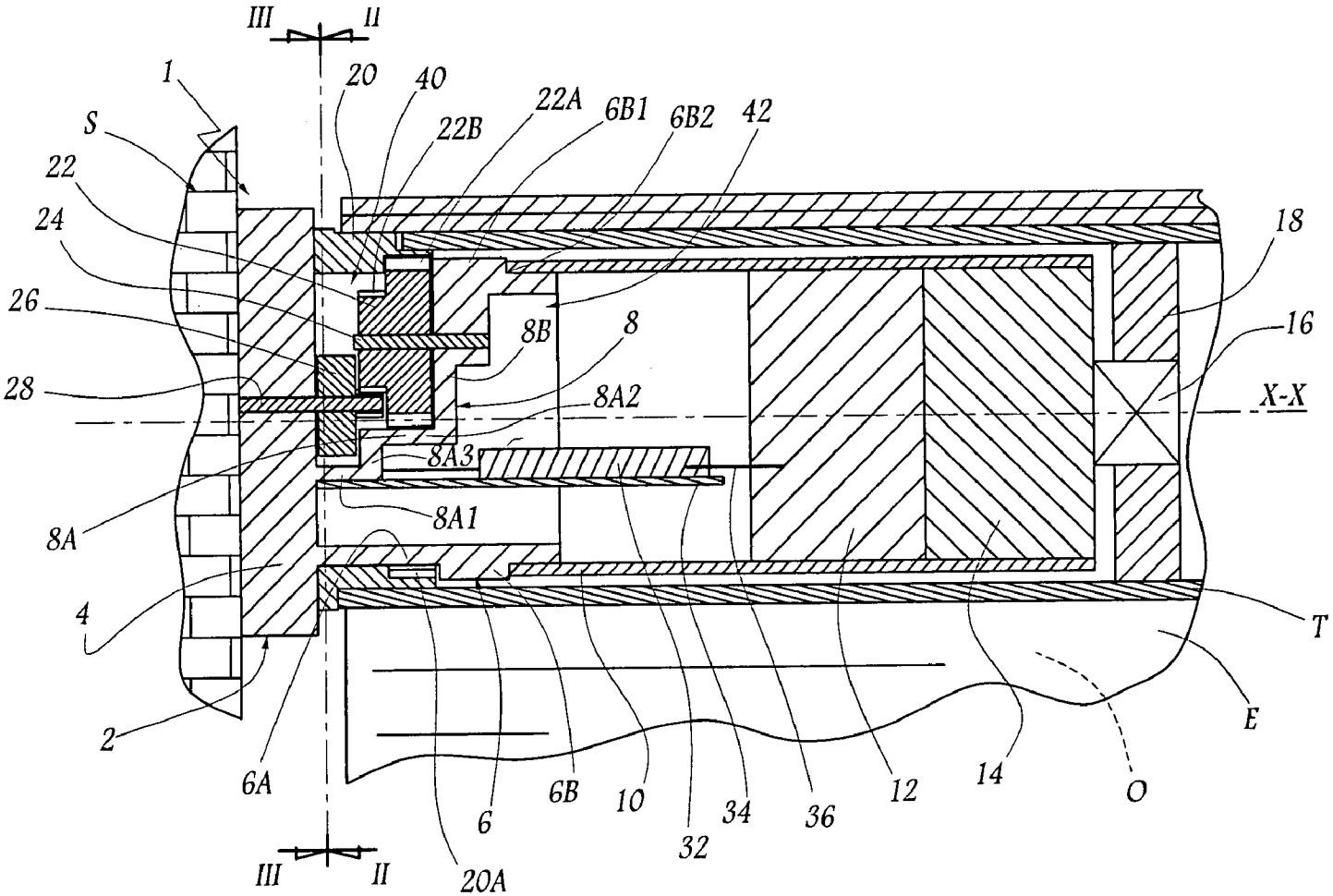
FIG. 1 schematically shows a partial longitudinal section of an installation according to the invention.

Referring now to the drawings, the installation of FIG. 1 comprises a closing or sun-protection screen E, intended to be selectively wound around a substantially horizontal tube T of axis X-X fixed with respect to the masonry of a fixed structure S in which is made an opening O to be obturated with the screen E. The winding tube T constitutes a member for displacement of the screen E and is mounted on a device 1 for reversible drive of the screen E.

This device 1 comprises a head 2 rigidly mounted on the masonry of the structure S. As shown in FIGS. 1 to 4, this head 2 comprises a solid base 4 in the form of a disc centered on axis X-X and mounted on the masonry and, on the side opposite the structure S, an annular skirt 6 centered on axis X-X.

For convenience, the term "front" in the following description will mean "directed towards the masonry", i.e. directed towards the left in FIG. 1, while the term "rear" corresponds to the opposite direction. Moreover, for reasons of visibility, the skirt 6 is shown in solid lines in FIG. 4, while, in this view, the major part of this skirt should be masked by the base 4 shown solely in dashed and dotted lines.

The skirt 6 is constituted by a front part 6A detailed hereinafter and by a cylindrical rear part 6B of axis X-X. The outer face of the rear part 6B is provided, at its front end, with a projecting rib 6B1 which extends over the whole periphery of the skirt. This rib 6B1 thus defines with the rest of the outer face of the part 6B, a shoulder 6B2.

Figure 3:
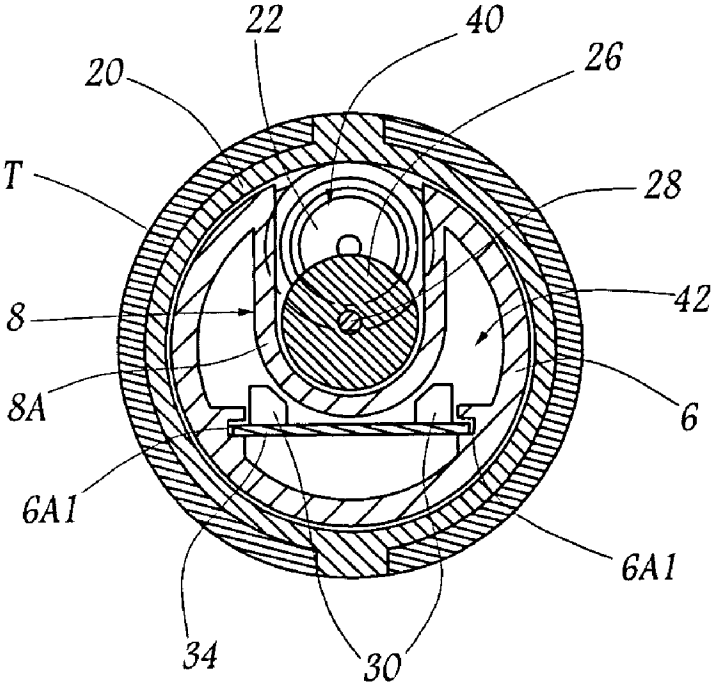
FIGS. 2 and 3 are plane sections along arrows II-II and III-III indicated in FIG. 1.
Figure 2:
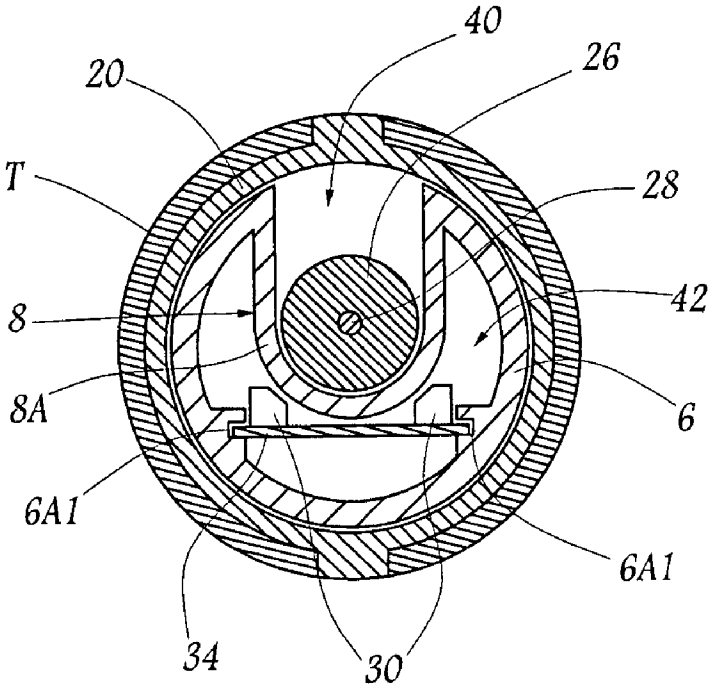
Figure 4:
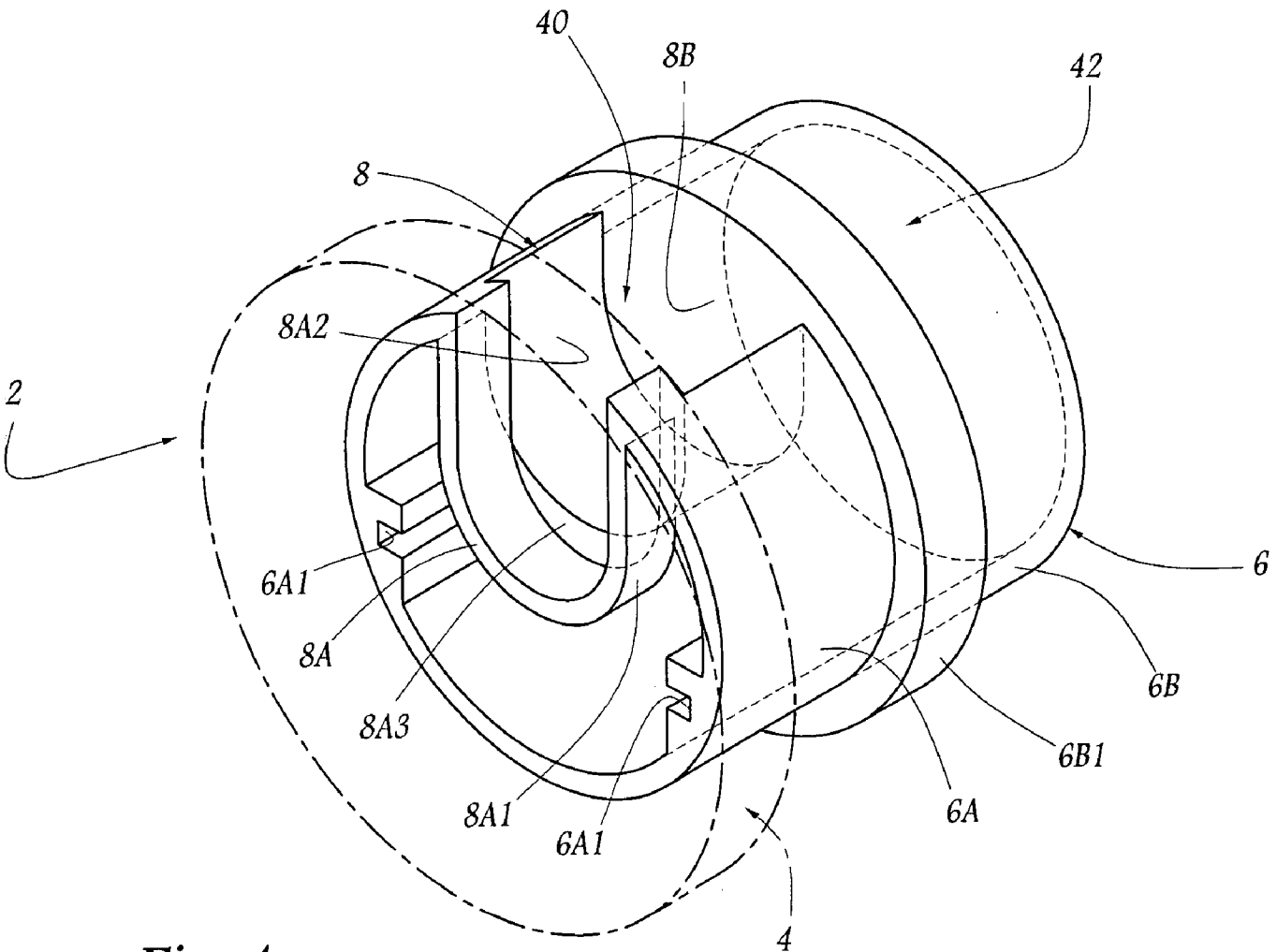
FIG. 4 is a view in perspective of a part of the installation of FIG. 1.

Unlike the rear part 6B, the front part 6A of the skirt 6 does not extend, in cross section, over the whole of the circular periphery of the base 4, but is interrupted in the upper part, i.e. in the upper parts of FIGS. 1 to 3, with the result that a partition or rib 8 connects the interrupted opposite skirt parts.

The partition 8 comprises, on the one hand, an axial wall 8A which projects towards the rear of the base 4 essentially in the direction X-X and which presents a substantially U-shaped cross section (FIGS. 2 and 3) and, on the other hand, a radial wall 8B parallel to the base 4, from which the axial wall 8A projects forwardly and which extends radially upwardly up to the rear part 6B of the skirt 6, forming the front end of the rib 6B1.

The axial wall 8A is constituted by a front part 8A1 and by a rear part 8A2 of which the depth, with respect to the level where the front part 6A of the skirt 6 is interrupted by the partition 8, is less than that of the front part 8A1. A transverse part 8A3 connects the front (8A1) and rear (8A2) parts of the axial wall 8A.

In this form of embodiment, the partition 8 and the skirt 6 form one piece, integral with the base 4. In other words, the head 2 constituted by the base 4, the skirt 6 and the partition 8 is a one-piece part, preferably made of a synthetic material. This part is, for example, obtained by molding.

A sleeve 10 of axis X-X is rigidly mounted, for example by force-fitting, around the rear part 6B of the skirt 6, being axially wedged against the shoulder 6B2 and with the possible interposition of an O-ring or the like (not shown). This sleeve internally receives a motor 12 and its associated reduction gear 14 from which extends an output shaft 16 in engagement with a distance piece or a transverse disc 18 of the winding tube T. On the structure S side, the tube T is supported by the front part 6A of the skirt 6, with the interposition of an annular ring 20 centered on the axis X-X and kinematically linked to the tube.

The ring 20 is provided with an inner toothing 20A in mesh with a cylindrical double-tooth pinion 22 at its rear toothing 22A. This pinion is mounted to rotate freely about a shaft 24 parallel to axis X-X and supported by the radial wall 8B of the partition 8. The front toothing 22B which is of smaller diameter than that of the pinion rear toothing 22A is in mesh with a toothed wheel 26 mounted to rotate freely about a shaft 28 supported by the base 4 of the head 2. The diameter of the toothing 22B is smaller than that of the toothing 22A, such that the movement of rotation of the wheel 26 is geared down with respect to that of the ring 20, i.e. that of the winding tube T.

In order to render the mechanical part constituted by the pinion 22 and the wheel 26 as compact as possible, the wall 8 is advantageously dimensioned both so that the depth of the rear part 8A2 of the axial wall 8A is substantially equal to the outer diameter of the rear toothing 22A of the pinion 22, for the axial distance separating the base 4 from the transverse part 8A3 of the axial wall 8A to be substantially equal to the axial dimension of the wheel 26, this ensuring axial wedging of the latter, and so that the axial distance separating the base 4 from the radial wall 8B is substantially equal to the sum of the axial dimensions of the wheel 26 and the pinion 22, this ensuring the axial wedging of the pinion. By respecting the detailed dimensioning hereinabove, it is possible, by way of variant (not shown), to dispense with the shafts 24 and 26, the partition 8 ensuring guiding of the pinion 22 and the wheel 26 in rotation. The spacings of the respective branches of the U's formed by the transverse sections of the front (8A1) and rear (8A2) parts of the wall 8A, as well as the curvature of the bottom of these U's, then correspond to the respective diameters of the wheel 26 and of the toothing 22A of the pinion 22 and to their respective curvature.

The wheel 26 is polarized, i.e. it is provided along its periphery with a succession of magnetic poles, in a predetermined geometry. This wheel is for example made of plastoferrite magnetized after injection. By noting the position and the displacement of these magnetized zones about shaft 28, it is possible to determine the position and corresponding displacement of the tube T.

To that end, the device 1 comprises two Hall effect sensors 30 connected to an electronic processing unit 32. More precisely, the device 1 is equipped with a printed circuit board 34, connected to the head 2 and projecting from the base 4 in the direction X-X in part below the partition 8. The board is for example slid and retained in appropriate notches 6A1 provided on the inner face of the skirt 6 as shown in FIGS. 2 and 3. On this board are mounted, on the one hand, sensors 30 which, when the board is connected to the head 2, are disposed substantially in the median transverse plane of the magnet wheel 26 so as to react to the magnetic fields generated by the magnetized zones of the wheel, and, on the other hand, the electronic components of the unit 32, the sensors 30 being connected to this unit for example by electrical conductors provided in the board 34.

The processing unit 32 is adapted to analyze the signals emitted by the Hall effect sensors 30 so as to determine the position and the movement of the magnet wheel 26 and consequently those of the winding tube T, as well as to control, if necessary, the electrical supply of the motor 12, via a control link 36.

In order to ensure tightness of the electronic components of the device 1, i.e. the sensors 30 and the unit 32, these components are located on the side, turned towards the motor 12, of the partition 8 while the wheel 26 and the pinion 22 are located on the other side. In this way, any infiltration of water or of humidity penetrating between the tube T and the ring 20 remains limited to the level of the pinion 22 and of the wheel 26, without being able to pass through the tight partition 8 to attain the sensors 30 and/or the unit 32. In order not to disturb the Hall effect sensors 30, the matter constituting the partition 8 does not induce any noteworthy electromagnetic disturbance.

In other words, the partition 8 defines on either side of its axial (8A) and radial (8B) walls two distinct compartments, namely a first, upwardly open compartment 40 which essentially receives the pinion 22 and the wheel 26 and which is axially closed at the front by the base 4 and at the rear by the radial wall 8B and, on the other hand, a second compartment 42 closed radially by the skirt 6, which essentially receives the sensors 30, the electronic unit 32 and the board 34 and which is closed at the front by the base 4 and open at the rear.

It will be noted that the term "compartment" generally covers any hollow housing which, in transverse section, is defined at least in part by a substantially concave wall.

Along a transverse section of the device 1, for example the section of FIGS. 2 and 3, these compartments 40 and 42 are advantageously superposed, the axial wall 8A of the partition 8 being interposed therebetween. In this way, the space requirement of the device 1 in length is reduced. Moreover, as the magnet wheel 26 is axially located between the base 4 and the pinion 22, the axial space requirement of the compartment 40 is reduced and the sensors 30 located in the compartment 42 are brought as close as possible to the base 4 in order to detect the magnetic fields generated by the wheel so as to disengage a considerable free volume in the compartment 42 to arrange the board 34 and the electronic components of the unit 32. Furthermore, by molding the base 4, the skirt 6 and the partition in one piece, a part is obtained which determines both the position of the magnet wheel 26 and the position of the sensors 30, this making it possible to master, as best possible, the tolerances determining the relative positioning of the wheel and the sensors.

The part 8A1 of the wall 8A is concave seen from the housing 40 and convex seen from the housing 42. In this way, the wheel 26 is partially surrounded by the partition 8. In practice, the partition 8 surrounds the wheel 26 over about 180°.

The housing 40, which is concave around the wheel 26, is compact and extends only over a relatively small angular sector with respect to the periphery of the skirt 6.

The geometry of the partition 8 makes it possible, particularly thanks to its portions 8A1 and 8A2, to receive in the housing 40 the transmission formed by elements 22 and 26 which constitute a movement multiplier assembly allowing a detection of the rotation of the tube T with high precision, while this assembly is compact.

The use of a multiplier assembly 22, 26 which has a relatively large pole pitch, makes it possible to space the sensors 30 from the wheel 26 without risk of interference between the poles of the wheel 26. In this way, the sensors 30 do not have to be in the immediately vicinity of the wheel 26, this making it possible to design the wall 8 with a sufficient thickness to ensure good solidity of the assembly.

The geometry of the partition 8 also means that the sensors 30, the board 34 and the unit 32 may be localized in a central part of the tube T. These elements 30, 32 and 34 therefore do not have to be especially configured to be disposed in the vicinity of the internal wall of the tube which is not planar.

The device 1 functions as follows:

When the screen E is wound around the tube T or unwound from that tube, the latter drives in rotation, in a corresponding movement, the annular ring 20 whose movement is transmitted to the magnet wheel 26 via the pinion 22. The position and the displacement of this wheel, representative of the position and the displacement of the tube T, are detected by the sensors 30 of which the signals are transmitted to the processing unit 32 which then determines by calculation the position and the displacement of the tube. As a function of a pre-determined setting, the unit 32 then controls, if necessary, the stopping or slowing down of the motor 12, for example if the unit concludes that the screen E has arrived at the end of stroke.

By using two Hall effect sensors 30 as in device 1, it is possible to identify the direction of rotation of the magnet wheel 26, and consequently that of the winding tube T. By way of variant, one sole Hall effect sensor 30 is provided, particularly if the determination of the direction of rotation is not necessary or if it is determined by other means.

Figure 6:
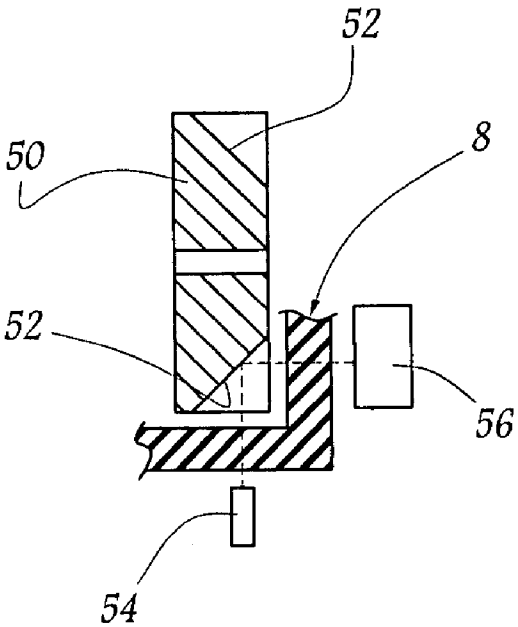
FIGS. 5 and 6 illustrate a variant of the drive device according to the invention, FIG. 6 being in part a section along plane VI-VI indicated in FIG. 5.
Figure 5:
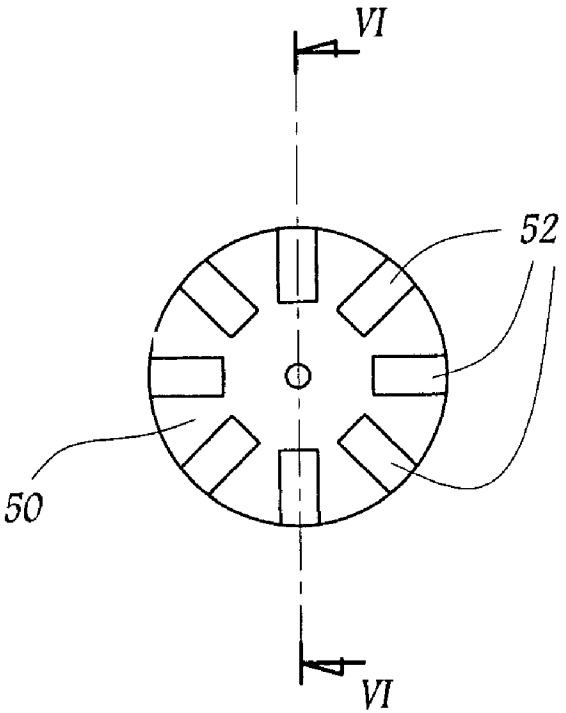

FIGS. 5 and 6 show a variant of the drive device 1 of FIGS. 1 to 3. In this variant, the magnet wheel 26 is replaced by a disc-shaped optical wheel 50, which bears over its periphery eight bevelled reflecting surfaces 52. In order to allow detection of the position and the movement of this wheel 50, the sensors 30 of the device of FIGS. 1 to 3 are replaced by one or more assemblies constituted by an emitter 54 of light beams and a corresponding receiver 56 connected to a processing unit similar to unit 32, able to process electronically the signals furnished by this receiver. This receiver is adapted to detect the reflection of the light beam emitted by the emitter 54 on one of the reflecting surfaces 52.

In this variant, the tight partition 8 is interposed between the optical wheel 50 and the or each emitter 54/receiver 56 assemblies, as shown in FIG. 5.

The partition 8, or at least that part of the partition located on the path of the light beams, i.e. opposite the emitter 54 and the receiver 56, is constituted by a material transparent to the light beams employed. The partition 8 is in that case made, for example, by means of a molding technique with two materials or by the addition of a transparent welded element.

Various arrangements and variants to the drive devices described hereinabove may in addition be envisaged. By way of example:

- the partition 8 is connected tightly on the base 4 of the head 2, by screwing, clipping or adhesion for example.
- the detection means, such as the Hall effect sensors 30, may be embedded in the material constituting the partition 8; and/or
- that part of the base 4 which closes the front of the compartment 40 may be axially pierced to allow the introduction of the pinion 22 and the wheel 26 in this compartment; in that case, the transverse section of the axial wall 8A1 may be more closed on itself, for example shaped as a C, while remaining open in a zone of its periphery to ensure meshing of the toothings 20A and 22A.

What is claimed is:

1. A device for driving a screen between open and closed positions relative to an opening, comprising a gear motor unit, a winding tube for displacing the screen and defining an inner chamber in which the gear motor is mounted, the winding tube being controlled in rotation about an axis by the gear motor unit, a head fixedly mounted on a support structure adjacent the opening and supporting the winding tube, a rotational part within the winding tube, drive means for rotating the rotational part in response to rotation of the winding tube, the rotational part including an element representative of a position and/or a displacement of the winding tube, sensor means for detecting the position and/or the displacement of the element, the sensor means being connected to an electronic processing unit adapted to determine the position and/or the displacement of the winding tube, a partition secured to the head and extending therefrom into one end of the winding tube, the partition defining, on one side toward the head, a first compartment in which the rotational part is mounted and, on another side, a second compartment in which at least the electronic processing unit is mounted, the partition sealing the second compartment so that the electronic processing unit is sealed relative to the first compartment and the rotational part, the partition including a first axial wall extending from the head inwardly within the one end of the winding tube toward the motor and a radial wall closing the first axial wall within the winding tube, and the first axial wall including at least one wall segment in which the rotational part is positioned.

2. The device of claim 1, wherein the partition is integral with the head.

3. The device of claim 1, wherein the wall segment in which the rotatable part is positioned is generally U shaped.

4. The device of claim 1, wherein the first compartment is axially closed, at one end, by a part of the head and, at the opposite end, by the first radial wall of the partition.

5. The device of claim 1, including a ring secured to rotate with the winding tube and at least one rotatable gear member interposed between the ring and the rotational part, the at least one rotatable gear member being located in the first compartment.

6. The device of claim 5, wherein the rotational part is adjacent to the head and the at least one rotatable gear member is adjacent to the radial wall of the partition.

7. The device of claim 1, wherein the partition includes, on the first compartment side thereof, at least one surface for guiding the rotational part in rotation.

8. The device of claim 7, wherein the at least one surface also guides the drive means in rotational movement within the first compartment.

9. The device of claim 1, wherein the sensor means is positioned in the second compartment.

10. The device of claim 1, wherein the element of the rotational part includes at least one reflecting surface and the sensor means includes at least one emitter and at least one receiver of a light beam.

11. A closure device for an opening in a building, wherein the closure device comprises a screen mounted to be wound upon a winding tube, a device for driving the winding tube to deploy or rewind the screen relative to the opening, a gear motor unit mounted within the winding tube for displacing the screen and defining an inner chamber in which the gear motor is mounted, the winding tube being controlled in rotation about an axis by the gear motor unit, a head fixedly mounted on the building adjacent the opening and supporting the winding tube, a rotational part within the winding tube, drive means for rotating the rotational part in response to rotation of the winding tube, the rotational part including an element representative of a position and/or a displacement of the winding tube, sensor means for detecting the position and/or the displacement of the element, the sensor means being connected to an electronic processing unit adapted to determine the position and/or the displacement of the winding tube, a partition secured to the head and extending therefrom into one end of the winding tube, the partition defining, on one side, a first compartment in which the rotational part is mounted and, on another side, a second compartment in which at least the electronic processing unit is mounted, the partition sealing the second compartment so that the electronic processing unit is sealed relative to the first compartment and the rotational part, the partition including a first axial wall extending from the head inwardly within the one end of the winding tube toward the motor and a radial wall closing the first radial wall within the winding tube, and the first axial wall including at least one wall segment in which the rotational part is positioned.

12. The closure device of claim 11 wherein the wall segment in which the rotational part is positioned is generally U shaped.

* * * * *